US007044841B1

(12) United States Patent
Liao

(10) Patent No.: US 7,044,841 B1
(45) Date of Patent: May 16, 2006

(54) GRINDING MACHINE

(76) Inventor: Juei-Seng Liao, No. 396, Yung-Ming St., Ta-Li City, Taichung Hsien (TW)

( * ) Notice: Subject to any disclaimer, the term of this patent is extended or adjusted under 35 U.S.C. 154(b) by 0 days.

(21) Appl. No.: 11/208,322

(22) Filed: Aug. 19, 2005

(30) Foreign Application Priority Data

May 24, 2005 (TW) ..... 94208447 U

(51) Int. Cl.
*B24B 7/00* (2006.01)
*B24B 21/00* (2006.01)

(52) U.S. Cl. ..... 451/67; 451/456

(58) Field of Classification Search ..... 451/65, 451/67, 310, 355, 358, 359, 360, 361, 456
See application file for complete search history.

(56) References Cited

U.S. PATENT DOCUMENTS 4,305,231 A * 12/1981 Rasmussen ..... 451/65
5,168,656 A * 12/1992 Jolly et al. ..... 451/310
5,199,220 A * 4/1993 Steiner et al. ..... 451/65
5,231,801 A * 8/1993 Svetlik et al. ..... 451/456
6,416,403 B1 * 7/2002 Chiang ..... 451/453
6,699,108 B1 * 3/2004 Chiang ..... 451/87
6,749,492 B1 * 6/2004 Chiang ..... 451/296

* cited by examiner

*Primary Examiner*—Jacob K. Ackun, Jr.
(74) *Attorney, Agent, or Firm*—Townsend and Townsend and Crew LLP

(57) ABSTRACT

A grinding machine includes a driving unit, a grinding wheel unit, an abrasive belt unit and a dust-collecting device. The dust-collecting device includes a dust-discharging unit and a dust-guiding unit. The dust-discharging unit includes a dust-collecting seat disposed fixedly on a side cover of the grinding wheel unit, and a suction fan assembly disposed within the dust-collecting seat. The dust-guiding unit includes a conduit communicated with a dust-receiving chamber in the grinding wheel unit and an accommodating chamber in the abrasive belt unit. The grinding wheel unit, the abrasive belt unit and the suction fan assembly are driven by the driving unit. Dust is induced by the suction fan assembly to move from the dust-receiving chamber and the accommodating chamber into the dust-collecting seat.

6 Claims, 12 Drawing Sheets

GRINDING MACHINE

CROSS-REFERENCE TO RELATED APPLICATION

This application claims priority of Taiwanese Application No. 94208447, filed on May 24, 2005.

BACKGROUND OF THE INVENTION

1. Field of the Invention

This invention relates to a grinding machine, and more particularly to a grinding machine that includes a dust-collecting device.

2. Description of the Related Art

Referring to FIG. 1, a conventional grinding machine 10 includes a motor 11 with a motor shaft 111, a base 12 for supporting the motor 11, a control switch 13 disposed on the base 12 and operable to control starting and stopping of the motor 11, an abrasive belt unit 14, and a grinding wheel unit 15.

The abrasive belt unit 14 include a supporting member 141, a driving pulley 142 connected fixedly to the motor shaft 111, a driven pulley 143 disposed rotatably on the supporting member 141 and located above the driving pulley 142, an abrasive belt 144 trained on the driving pulley 142 and the driven pulley 143, and a workpiece-supporting plate 145 disposed fixedly on the supporting member 141 and in proximity to the abrasive belt 144.

The grinding wheel unit 15 includes a grinding wheel 151 connected fixedly to the motor shaft 111, and a protective cover 152 for covering partially the grinding wheel 151.

A disadvantage of the conventional grinding machine is that dust produced while performing a grinding operation is not collected. This adversely affects the cleanliness of the working environment, and is harmful to the health of users.

SUMMARY OF THE INVENTION

The object of this invention is to provide a grinding machine that includes a dust-collecting device, which can collect dust from a grinding wheel unit and an abrasive belt unit.

According to this invention, a grinding machine includes a driving unit, a grinding wheel unit, an abrasive belt unit and a dust-collecting device. The dust-collecting device includes a dust-discharging unit and a dust-guiding unit. The dust-discharging unit includes a dust-collecting seat disposed fixedly on a side cover of the grinding wheel unit, and a suction fan assembly disposed within the dust-collecting seat. The dust-guiding unit includes a conduit communicated with a dust-receiving chamber in the grinding wheel unit and an accommodating chamber in the abrasive belt unit. The grinding wheel unit, the abrasive belt unit and the suction fan assembly are driven by the driving unit. Dust is induced by the suction fan assembly to move from the dust-receiving chamber and the accommodating chamber into the dust-collecting seat.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
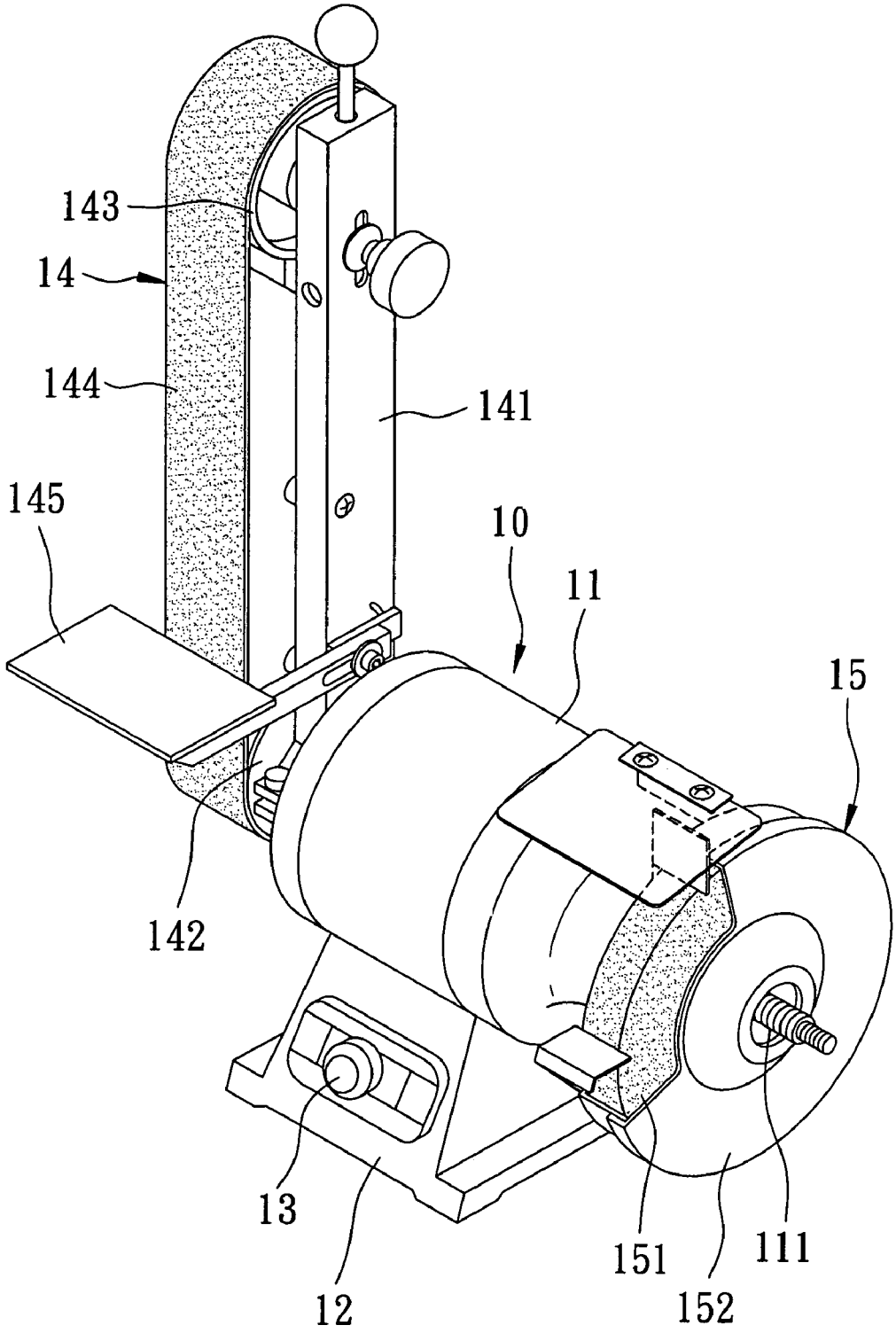
FIG. 1 PRIOR ART
FIG. 1 is a perspective view of a conventional grinding machine.

Before this invention is described in greater detail in connection with the preferred embodiment, it should be noted that reference characters (X, Y, X) in the drawings indicate respectively first, second and third directions, which are perpendicular to each other.

Figure 2:
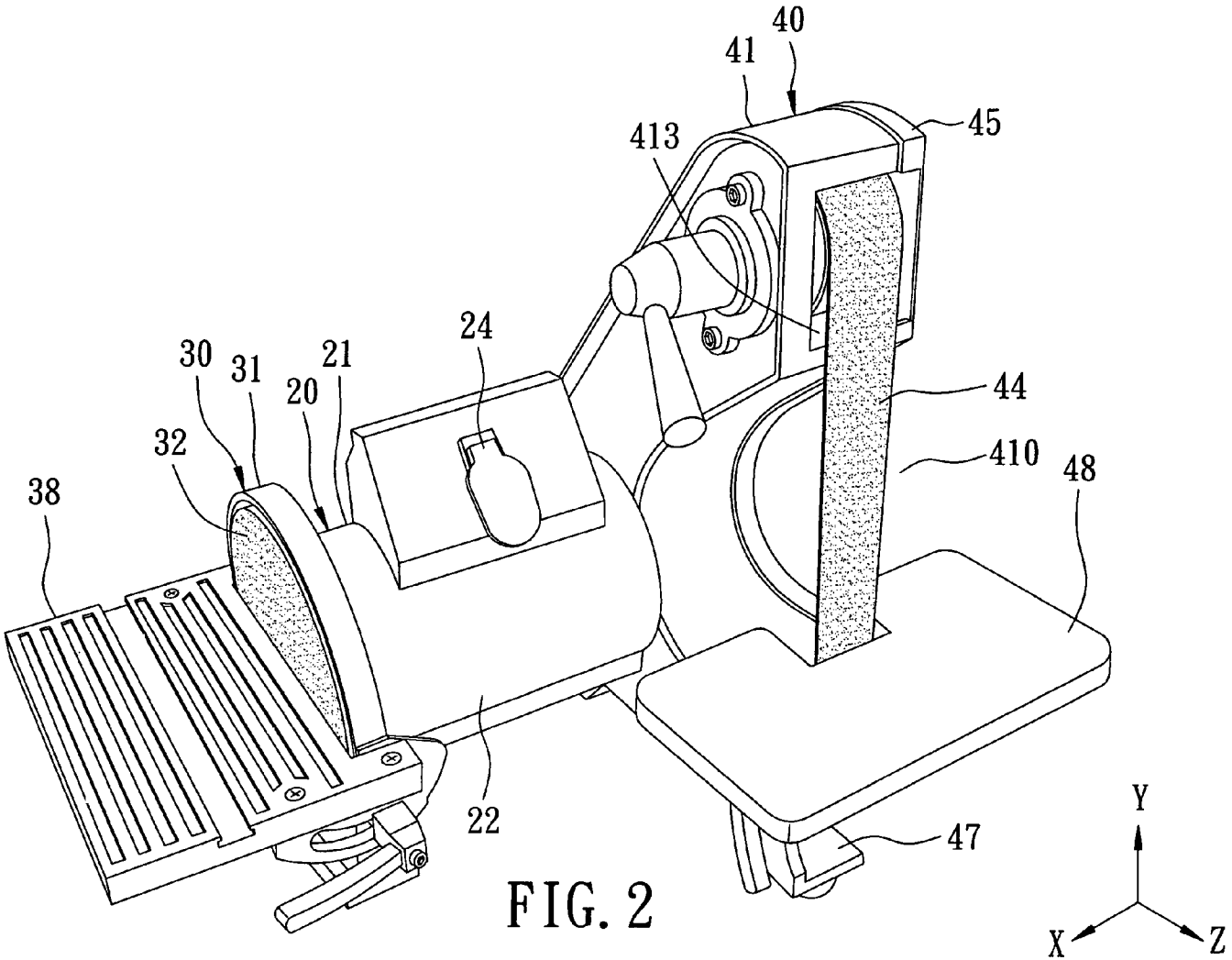
FIG. 2 is a perspective view of the preferred embodiment of a grinding machine according to this invention, which is viewed from a front left side.
Figure 3:
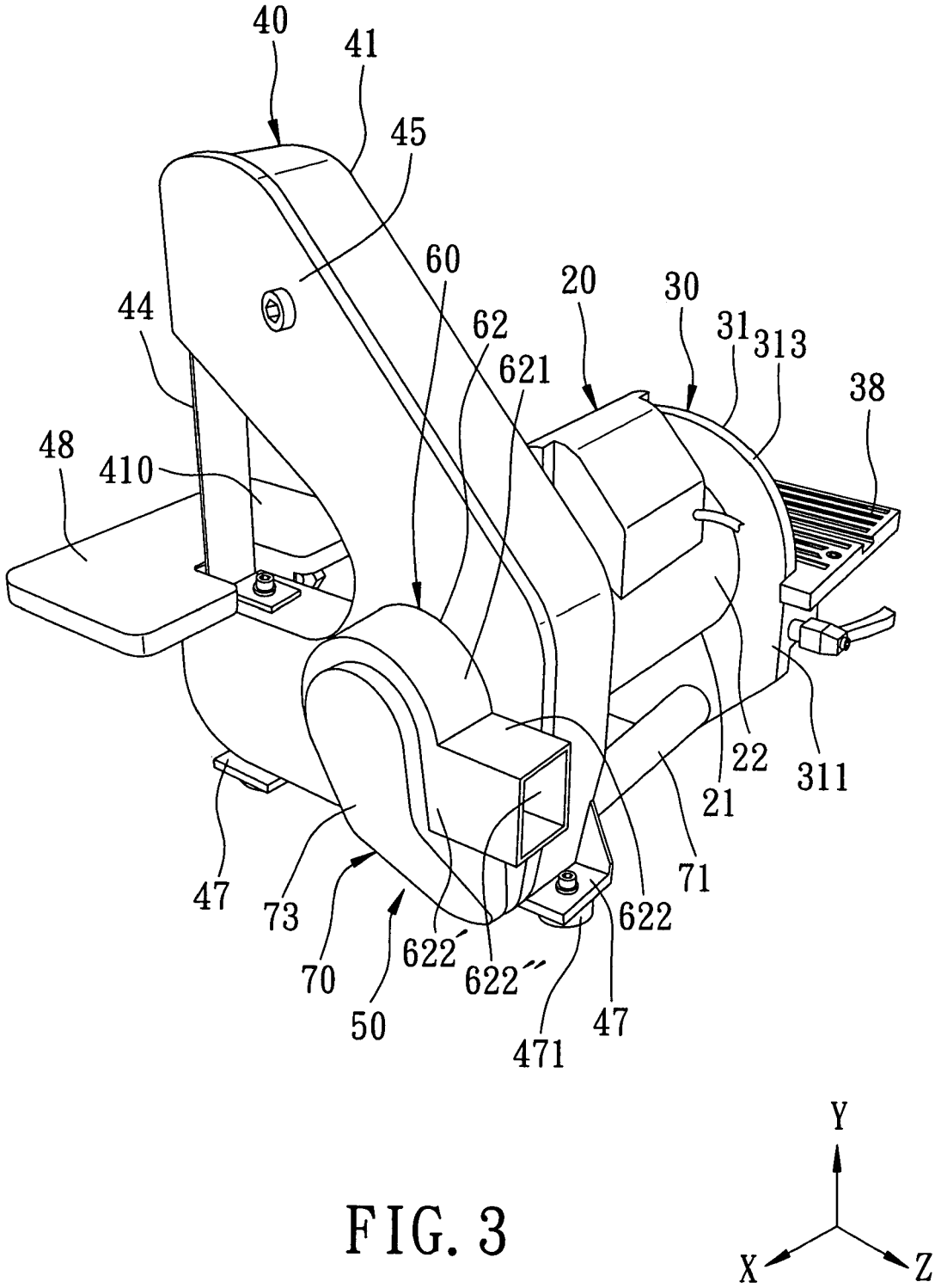
FIG. 3 is a perspective view of the preferred embodiment, which is viewed from a rear right side.

Referring to FIGS. 2 and 3, the preferred embodiment of a grinding machine according to this invention includes a driving unit 20, a grinding wheel unit 30, an abrasive belt unit 40 and a dust-collecting device 50.

Figure 6:
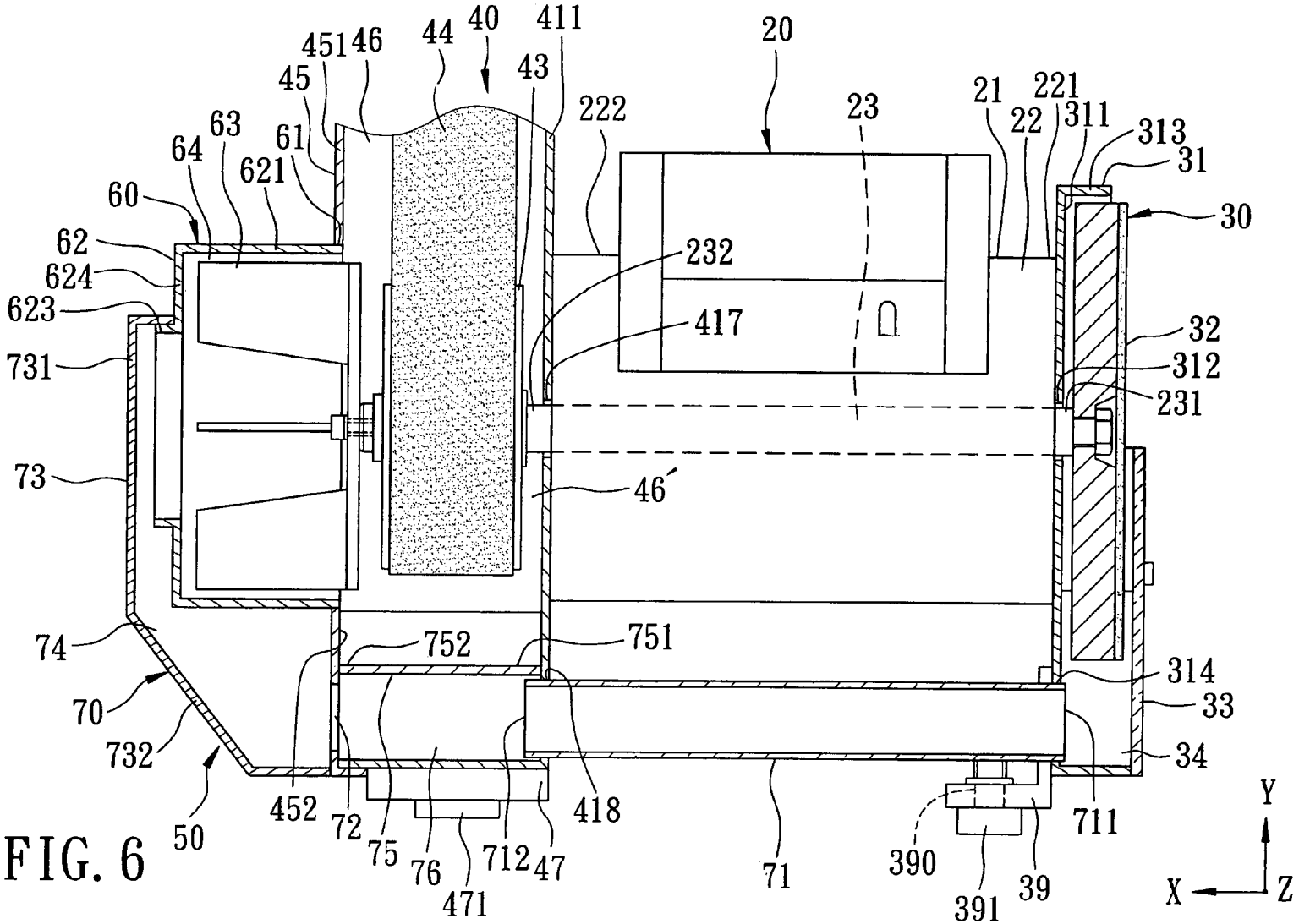
FIG. 6 is a fragmentary schematic rear side view of the preferred embodiment, illustrating a dust-guiding unit, the workpiece-supporting plate being removed.

Referring to FIGS. 2, 3 and 6, the driving unit 20 is disposed between the grinding wheel unit 30 and the abrasive belt unit 40, and includes a power source 21 configured as a motor, and a control switch 24 for controlling starting and stopping of the power source 21. The power source 21 includes a housing 22 and a driving shaft 23 journalled within the housing 22 and extending along the first direction (X). The housing 22 has opposite first and second ends 221, 222. The driving shaft 23 has opposite first and second ends 231, 232 extending respectively and outwardly from the first and seconds 221, 222 of the housing 22.

Figure 5:
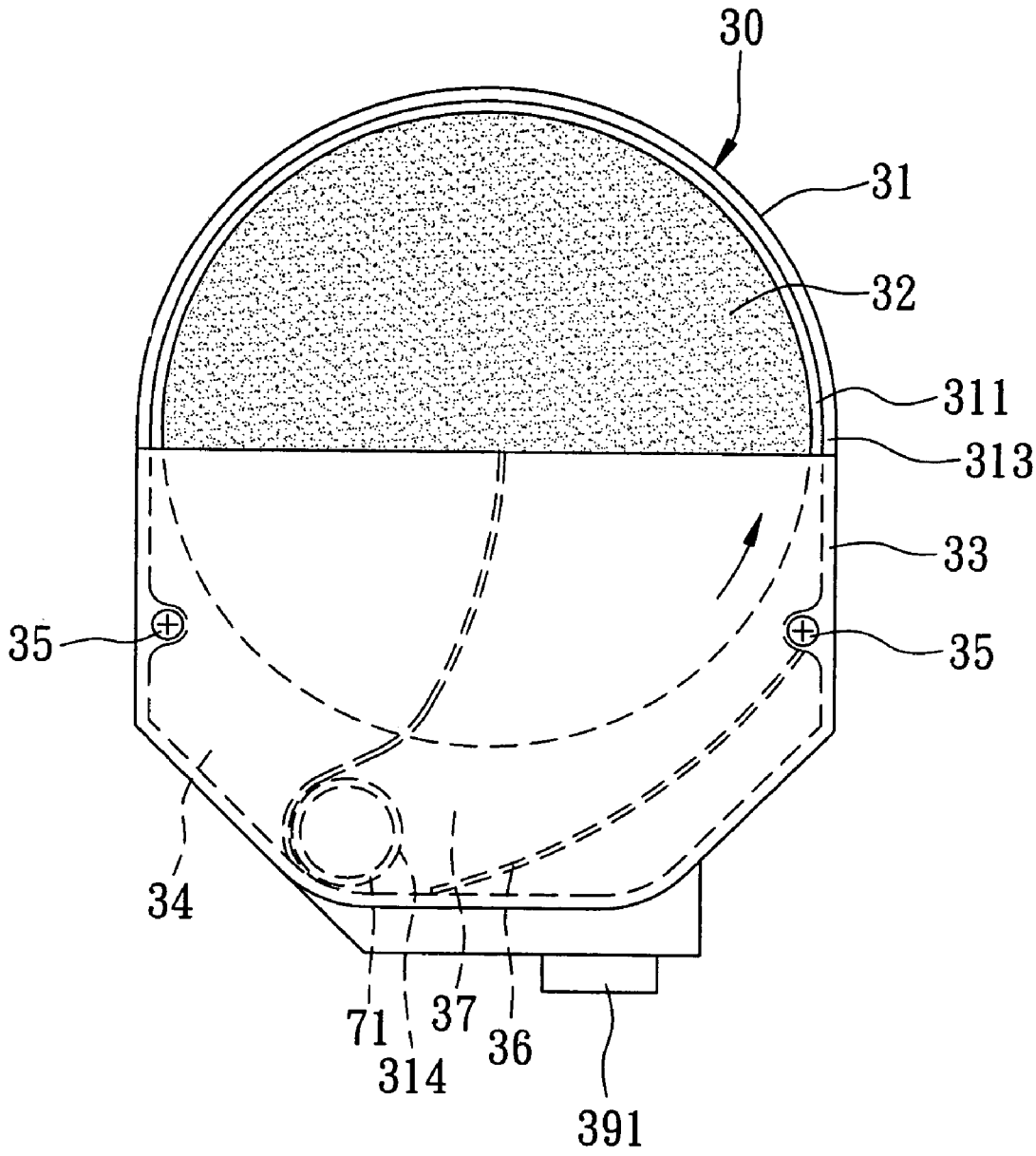
FIG. 5 is a schematic left side view of the preferred embodiment, illustrating a dust-receiving chamber in a grinding wheel unit, wherein a workpiece-supporting plate is removed.

Referring to FIGS. 2, 5 and 6, the grinding wheel unit 30 includes a support seat 31 disposed fixedly on the first end 221 of the housing 22, a grinding wheel 32 connected fixedly to the first end 231 of the driving rod 23, and a protective cover 33 mounted fixedly to the support seat 31 for covering a lower portion of the grinding wheel 32. The protective cover 33 cooperates with the support seat 31 to define a dust-receiving chamber 34 therebetween. The grinding wheel 32 is disposed between the protective cover 33 and the support seat 31.

The support seat 31 includes a support plate 311 disposed fixedly on the first end 221 of the housing 22 and having a through hole 312 for extension of the first end 231 of the driving rod 23 therethrough, and a surrounding plate 313 extending integrally and perpendicularly from the support plate 311 along the first direction (X). The support plate 311 is formed with an opening 314 that is disposed at a lower end thereof and that is communicated with the dust-receiving chamber 34. The protective cover 33 is connected fixedly to the surrounding plate 313.

The grinding wheel unit 30 further includes a generally U-shaped dust-guiding plate 36 disposed within the dust-receiving chamber 34 and having an end connected fixedly to the protective cover 33. The dust-guiding plate 36 has a lower end disposed around the opening 314 in the support plate 311, and cooperates with the support seat 31 and the protective cover 33 to define a dust-collecting space 37 thereamong so as to guide dust from the grinding wheel 32 into the opening 314. A horizontal workpiece-supporting plate 38 (not shown in FIGS. 5 and 6) is disposed fixedly on the support seat 31 and in proximity to the grinding wheel 32. The support seat 31 is provided with a fixed horizontal leg plate 39 that is formed with a threaded hole 390. A vertical first adjustment bolt 391 engages the threaded hole 390 in the leg plate 39, and extends along the second direction (Y).

Figure 7:
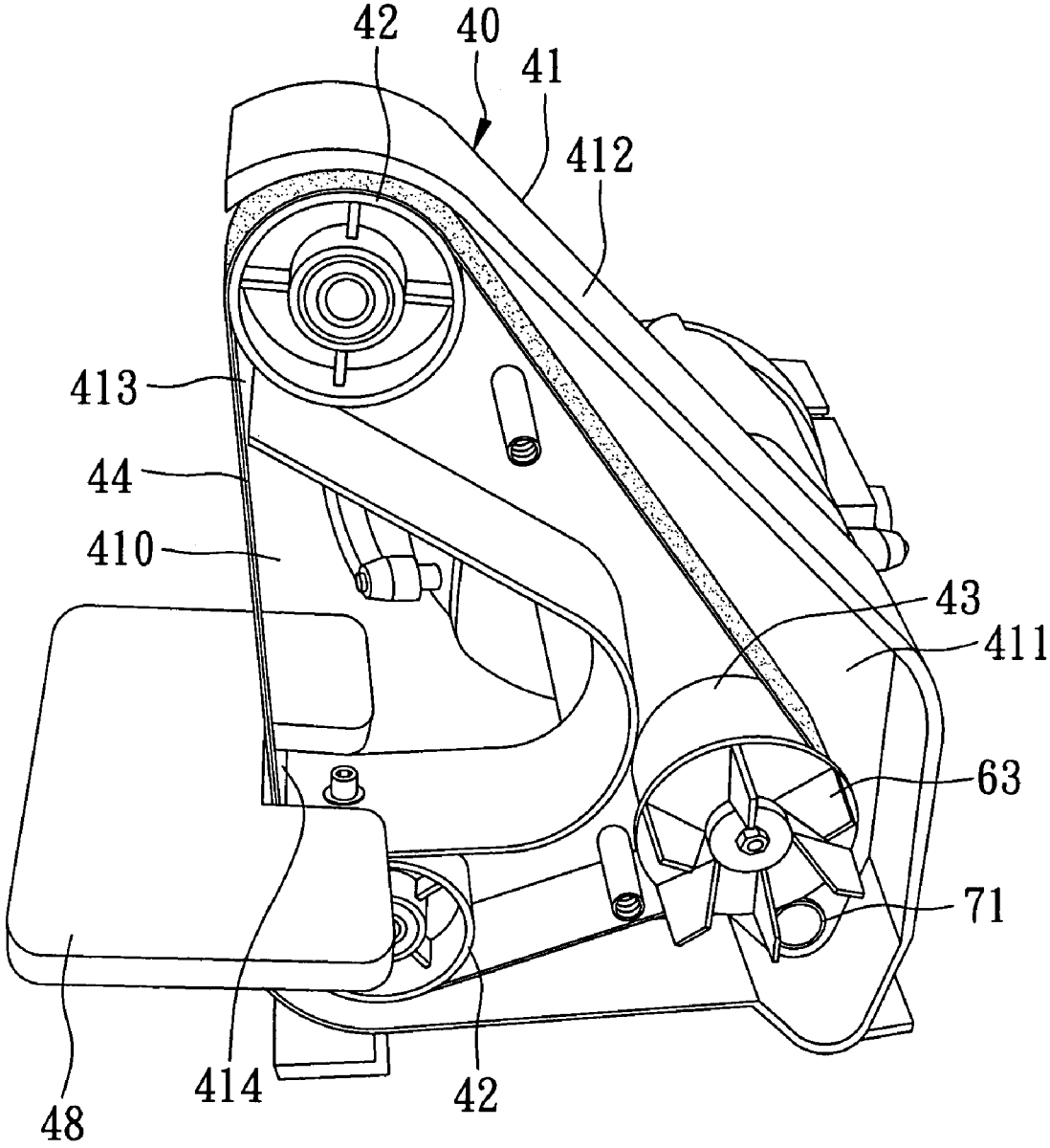
FIG. 7 is a perspective view of the preferred embodiment, wherein a side cover and a dust-collecting seat are removed for better illustration of an abrasive belt and a suction fan assembly.
Figure 8:
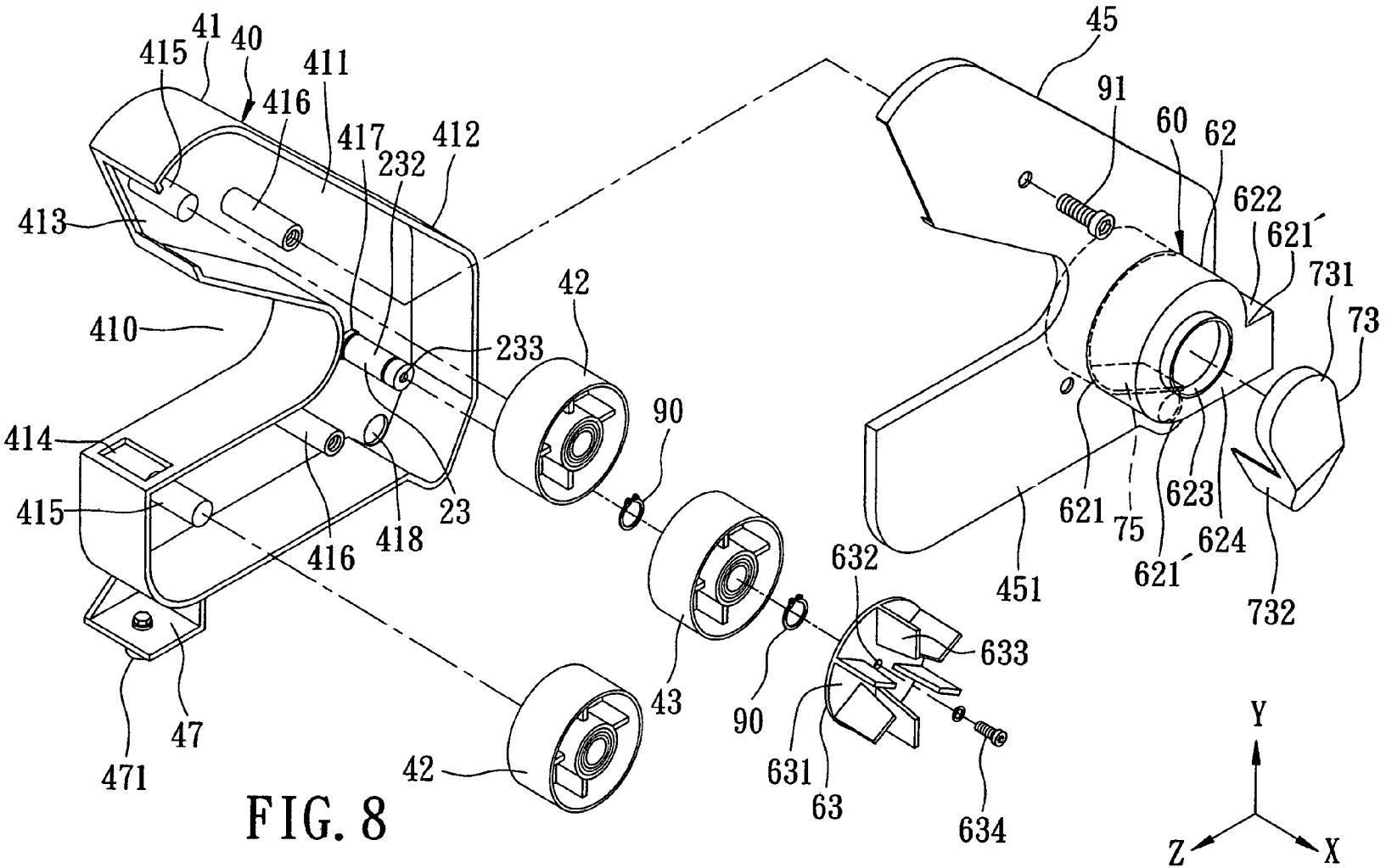
FIG. 8 is a fragmentary, partly exploded perspective view of the preferred embodiment, illustrating the grinding wheel unit.

Referring to FIGS. 3, 7 and 8, the abrasive belt unit 40 includes a base 41 disposed fixedly on the housing 22, two spaced-apart driven pulleys 42 disposed rotatably in the base 41, a driving pulley 43 disposed rotatably in the base 41 and connected fixedly to the second end 232 of the driving shaft 23 (see also FIG. 6), an abrasive belt 44 trained on the driving pulley 43 and the driven pulleys 42, and a side cover 45 connected fixedly to the base 41.

The base 41 includes a base plate 411, a surrounding plate 412, a notch 413, a dust inlet 414, two fixed shafts 415, two internally threaded rods 416, an upper through hole 417 and a lower through hole 418. The base plate 411 is generally U-shaped, and defines a gap 410. The surrounding plate 412 extends integrally and perpendicularly from an outer periphery of the base plate 411 along the first direction (X), and is disposed around the driven pulleys 42 and the driving pulley 43. The notch 413 is disposed directly above the dust inlet 414. The fixed shafts 415 are connected fixedly to the base plate 411. The driven pulleys 42 are sleeved respectively and rotatably on the fixed shafts 415. The internally threaded rods 416 are connected fixedly to the base plate 411. The upper and lower through holes 417, 418 are formed through the base plate 411. The second end 232 of the driving shaft 23 extends through the upper through hole 417. The lower through hole 418 is disposed under the upper through hole 417.

The driving pulley 43 is sleeved fixedly on the second end 232 of the driving shaft 23 by means of two C-shaped retaining rings 90. The abrasive belt 44 extends through the notch 413 and the dust inlet 414. The side cover 45 is locked to the internally threaded rods 416 by means of two bolts 91 (only one is shown in FIG. 8). Thus, an accommodating chamber 46 (see FIG. 6) is defined between the base plate 411 and the side cover 45.

Figure 4:
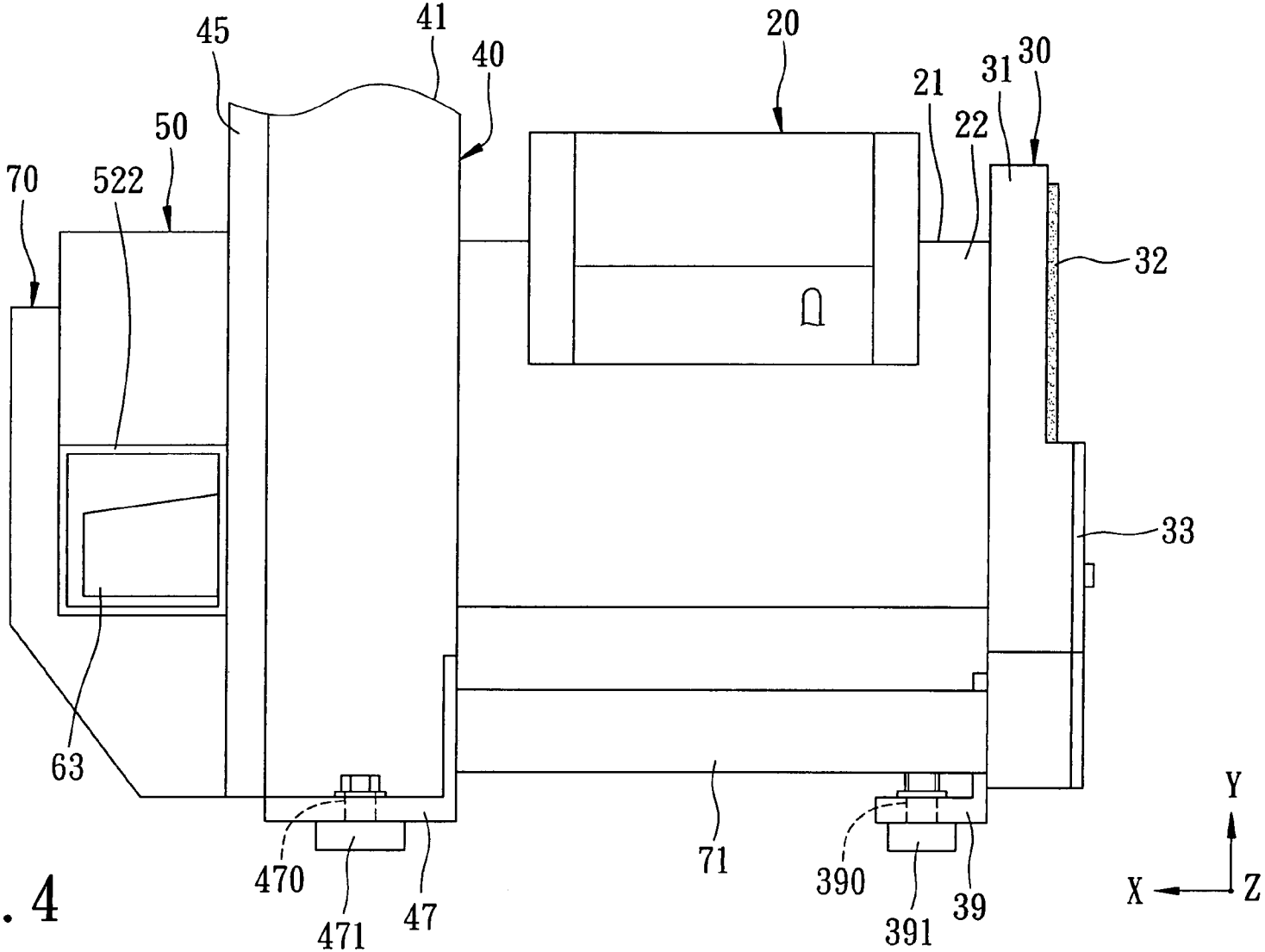
FIG. 4 is a fragmentary rear side view of the preferred embodiment, illustrating a plurality of leg plates and a plurality of adjustment bolts.

Referring to FIGS. 3, 4 and 8, the base 41 has opposite front and rear sides that are provided respectively with two fixed horizontal leg plates 47, each of which is formed with a threaded hole 470. Two vertical second adjustment bolts 471 engage respectively the threaded holes 470 in the leg plates 47, and cooperate with the first adjustment bolt 391 to support the grinding wheel unit 30 and the abrasive belt unit 40 stably on a support surface, such as the ground. A horizontal workpiece-supporting plate 48 is disposed fixedly on the base 41, and extends into the gap 410 of the base plate 411.

Referring to FIGS. 3, 6 and 8, the dust-collecting device 50 includes a dust-discharging unit 60 and a dust-guiding unit 70.

The dust-discharging unit 60 includes a through hole 61, a dust-collecting seat 62 and a suction fan assembly 63. The through hole 61 is formed through the side cover 45, and is aligned with the driving pulley 43.

The dust-collecting seat 62 is disposed fixedly on an outer surface 451 of the side cover 45, and is disposed around the through hole 61 in the side cover 45 to define a dust-discharging chamber 64 between the dust-collecting seat 62 and the side cover 45. The dust-collecting seat 62 includes a C-shaped plate 621, a dust-discharging tube 622 and a cover plate 624 that is formed with a dust inlet 623. The C-shaped plate 621 is connected fixedly to and extends perpendicularly from the side cover 45 along the first direction (X), and has two ends 621' (see FIG. 8). The dust-discharging tube 622 is connected fixedly to the side cover 45, and extends along the third direction (Z). The dust-discharging tube 622 has an inlet end 622' (see FIG. 3) connected fixedly to the ends 621' of the C-shaped plate 621, and an outlet end 622" (see FIG. 3) opposite to the inlet end 622' and defining a dust outlet in the dust-collecting seat 62.

The suction fan assembly 63 includes a connecting plate 631 abutting against an end surface of the second end 232 of the driving shaft 23 and formed with a hole 632, and a plurality of fan blades 633 extending integrally from the connecting plate 631. A bolt 634 extends through the hole 632 in the connecting plate 63 to engage a threaded hole 233 formed in the end surface of the second end 232 of the driving shaft 23 so as to allow for co-rotation of the suction fan assembly 63 and the driving shaft 23. The suction fan assembly 63 is disposed within the dust-discharging chamber 64, and is aligned with the dust inlet 623.

The dust-guiding unit 70 includes a conduit 71, a dust passage port 72 and a dust-guiding seat 73. The conduit 71 has opposite inlet and outlet ends 711, 712 (see FIG. 6) that are connected respectively and fixedly to the support seat 31 of the grinding wheel unit 30 and the base 41 of the abrasive belt unit 40 and that are communicated respectively with the opening 314 in the support plate 311, and the lower through hole 418 in the base plate 411. The outlet end 712 of the conduit 71 extends into the accommodating chamber 46 in the abrasive belt unit 40. The dust passage port 72 is formed through the side cover 45, and is aligned with the lower through hole 418 in the base plate 411 along the first direction (X). The dust-guiding seat 73 is connected fixedly to the cover plate 624 and the side cover 45 so as to define a dust-guiding chamber 74 thereamong. The dust-guiding chamber 74 is in fluid communication with the accommodating chamber 46 in the abrasive belt unit 40 via the dust passage port 72 in the side cover 45, and with the dust-discharging chamber 64 via the dust inlet 623 in the cover plate 624. The dust-guiding seat 73 has a first cover portion 731 for covering the dust inlet 623 in the cover plate 624, and a second cover portion 732 formed integrally with the first cover portion 731 for covering the dust passage port 72 in the side cover 45.

Figure 12:
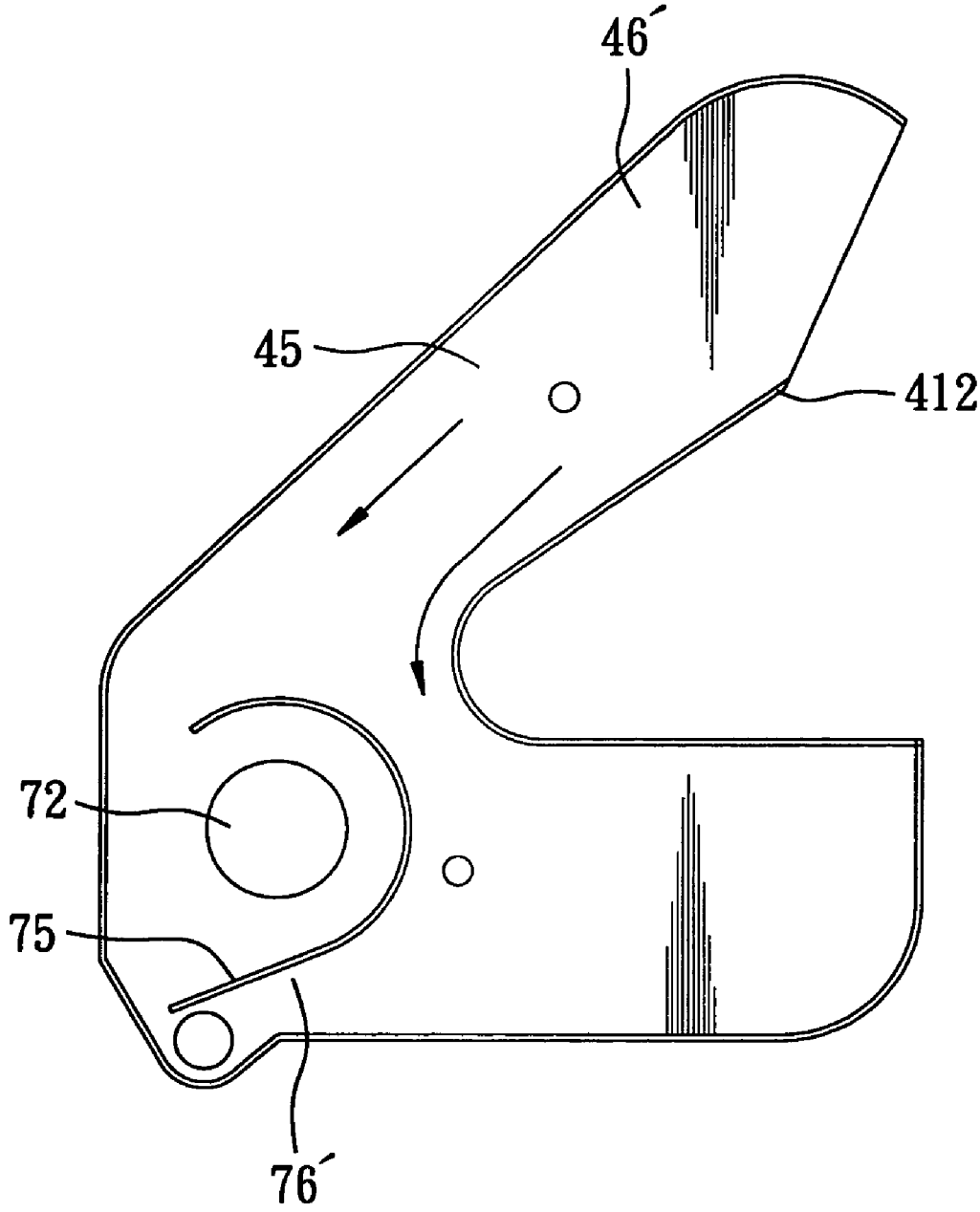
FIG. 12 is a schematic side view illustrating the position of a stop plate relative to a surrounding plate.

Referring to FIGS. 6, 8 and 12, the dust-guiding unit 70 further includes a curved stop plate 75 disposed within the accommodating chamber 46 in the abrasive belt unit 40 and connected fixedly to an inner surface 452 of the side cover 45. The stop plate 75 is spaced apart from the surrounding plate 412, and has a first end 751 (see FIG. 6) disposed directly above and adjacent to the outlet end 712 of the conduit 71, and a second end 752 abutting against the side cover 45 and disposed directly above and adjacent to the dust passage port 72 in the side cover 45. As such, a dust passage 76 is defined in the accommodating chamber 46 among the stop plate 75, the base plate 411 and the surrounding plate 412 so as to guide dust from the outlet end 712 of the conduit 71 into the dust passage port 72. As a result, the accommodating chamber 46 is divided by the stop plate 75 into the dust passage 76 disposed under the stop plate 75, and a belt-accommodating chamber portion 46' (see FIG. 6) disposed above the stop plate 75. The belt-accommodating chamber portion 46' is communicated with the dust passage 76 via spaces between the stop plate 75 and the surrounding plate 412, as shown in FIG. 12.

Figure 9:
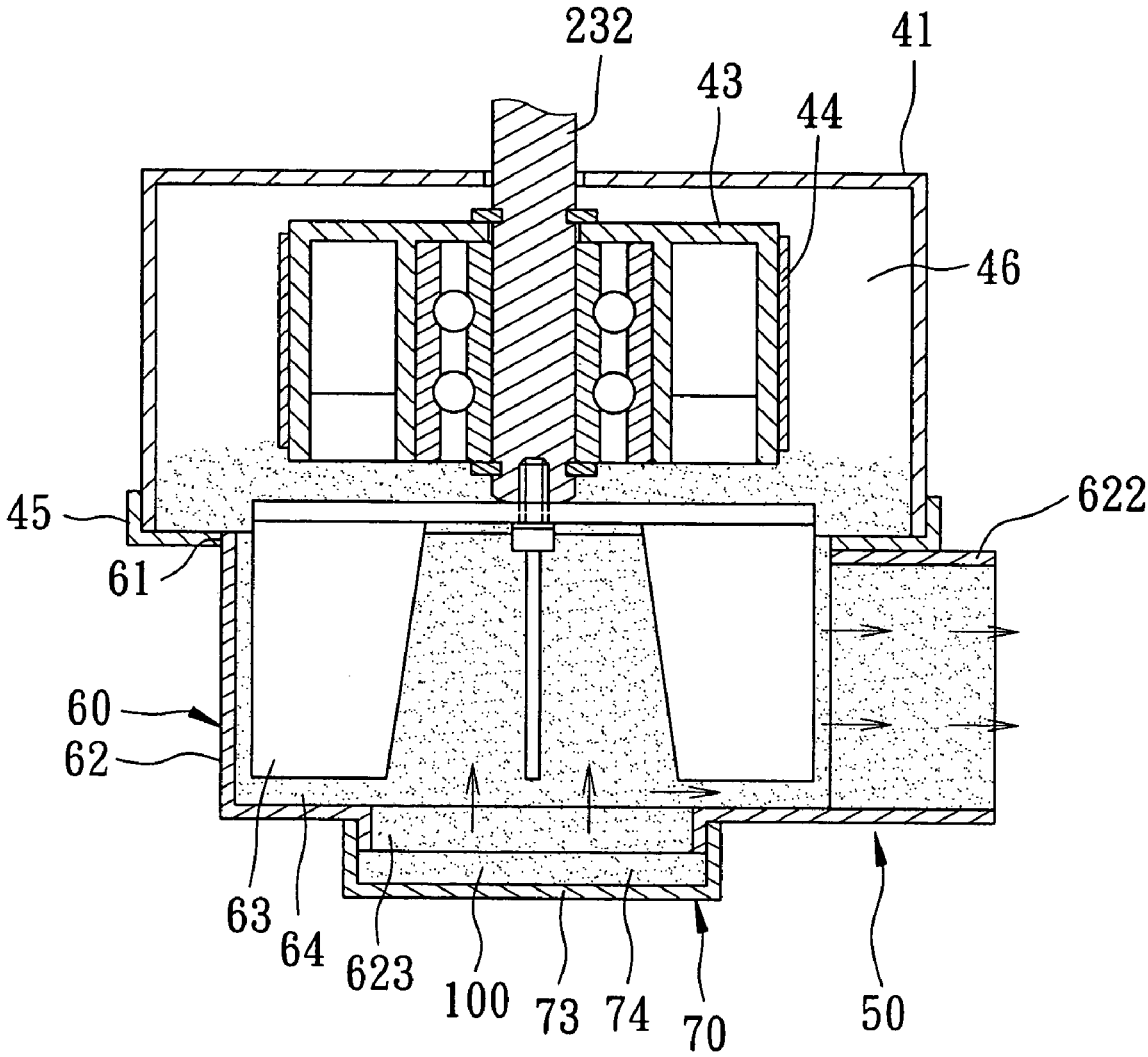
FIGS. 9 and 10 are fragmentary schematic sectional views of the preferred embodiment, illustrating a dust-collecting device.
Figure 10:
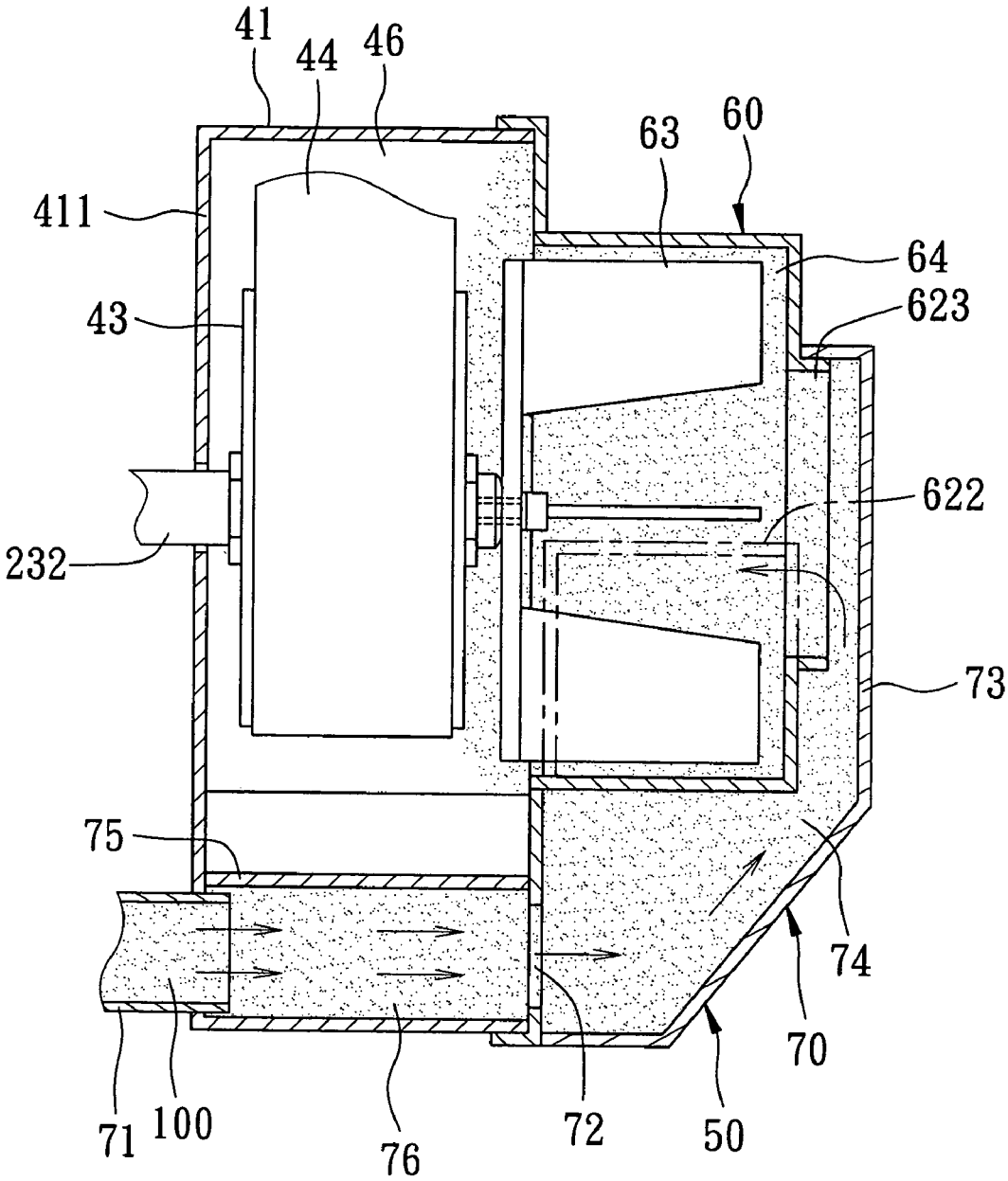

The control switch 24 (see FIG. 2) can be operated to activate the grinding wheel unit 30, the abrasive belt unit 40 and the suction fan assembly 63 at the same time. Referring to FIGS. 6, 9 and 10, during operation, dust 100 produced at the grinding wheel unit 30 is induced by the suction fan assembly 63 to move from the dust-receiving chamber 34 into the dust-collecting seat 62 via a path defined by the conduit 71, the dust passage 76 and the dust-guiding chamber 74. Furthermore, dust 100 produced at the abrasive belt unit 40 is induced by the suction fan assembly 63 to move from the accommodating chamber 46 into the dust-collecting seat 62 via a path defined by the dust passage 76 and the dust-guiding chamber 74.

Figure 11:
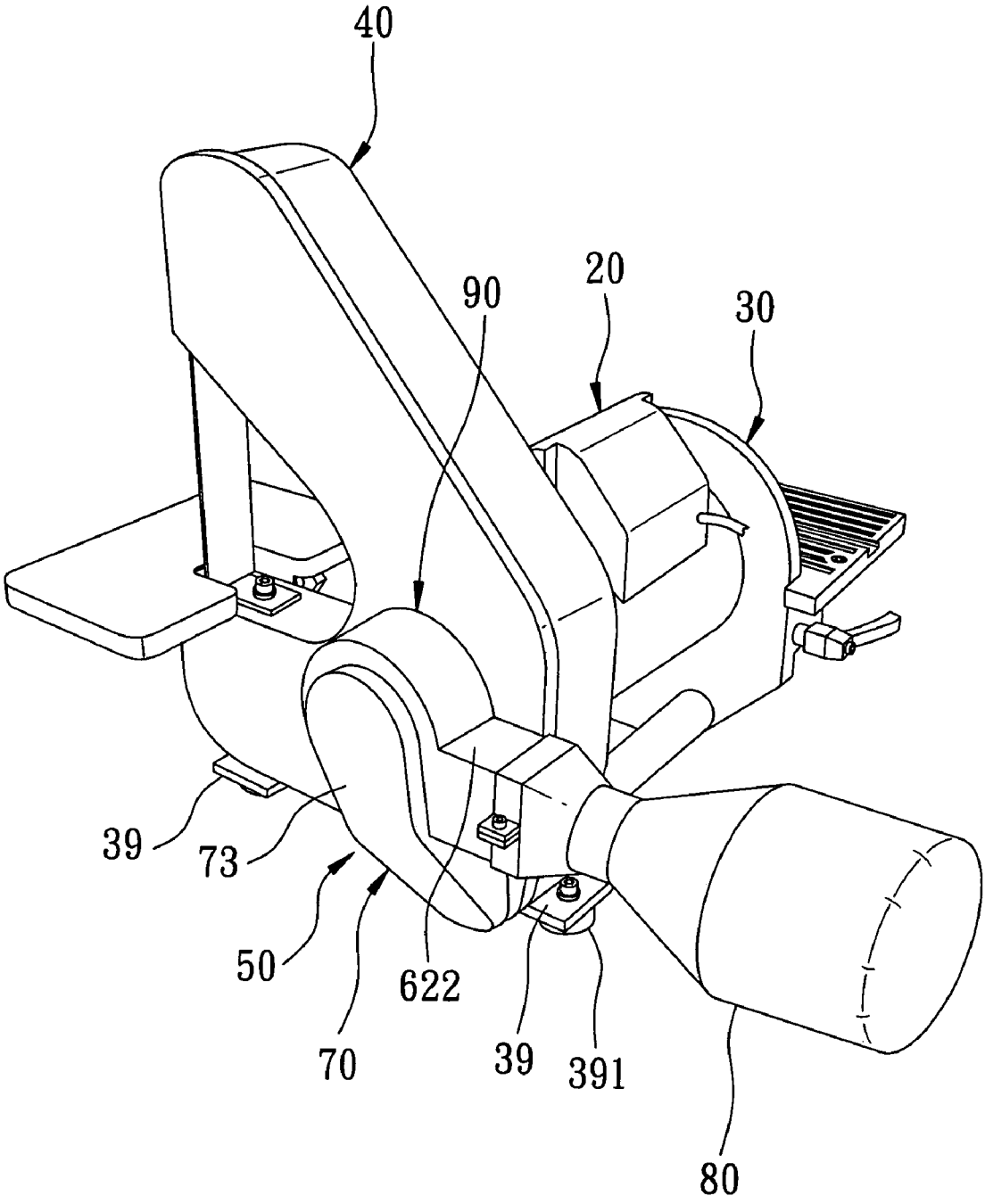
FIG. 11 is a perspective view of the preferred embodiment, illustrating how a dust-collecting bag is mounted to a dust-discharging tube.

A dust-collecting bag 80 (see FIG. 11) may be disposed on the outlet end 622" of the dust-discharging tube 622 (see FIG. 3) for receiving dust emitted from the dust-discharging tube 622.

With this invention thus explained, it is apparent that numerous modifications and variations can be made without departing from the scope and spirit of this invention. It is therefore intended that this invention be limited only as indicated by the appended claims.

I claim:

1. A grinding machine comprising:

a driving unit including a power source and a control switch for controlling starting and stopping of said power source, said power source including a housing and a driving rod or shaft journalled within said housing, said driving shaft having opposite first and second ends disposed outwardly of said housing;

a grinding wheel unit including a support seat disposed fixedly on said housing, a grinding wheel connected fixedly to said first end of said driving shaft, and a protective cover mounted to said support seat for covering a lower portion of said grinding wheel, said protective cover cooperating with said support seat to define a dust-receiving chamber therebetween, said grinding wheel being disposed between said support seat and said protective cover;

an abrasive belt unit including a base disposed fixedly on said housing, at least one driven pulley disposed rotatably in said base, a driving pulley disposed rotatably in said base and connected fixedly to said second end of said driving shaft, an abrasive belt trained on said driving pulley and said driven pulley, and a side cover connected fixedly to said base to define an accommodating chamber therebetween; and a dust-collecting device including a dust-discharging unit including a through hole formed through said side cover and aligned with said driving pulley, a dust-collecting seat disposed fixedly on said side cover and disposed around said through hole in said side cover to define a dust-discharging chamber between said dust-collecting seat and said side cover, and a suction fan assembly driven by said second end of said driving rod and disposed within said dust-discharging chamber, said dust-collecting seat having a dust inlet and a dust outlet, and a dust-guiding unit including a conduit connected fixedly to said support seat of said grinding wheel unit and said base of said abrasive belt unit at two opposite ends thereof, a dust passage port formed through said side cover of said abrasive belt unit, and a dust-guiding seat connected fixedly to said side cover of said abrasive belt unit and said dust-collecting seat so as to define a dust-guiding chamber thereamong, said dust-guiding chamber being in fluid communication with said dust passage port in said side cover and said dust inlet in said dust-collecting seat so that dust is induced by said suction fan assembly to move from said dust-receiving chamber in said grinding wheel unit into said dust-collecting seat via a path defined by said conduit, said accommodating chamber and said dust-guiding chamber.

2. The grinding machine as claimed in claim 1, wherein said support seat of said grinding wheel unit has a lower end that is formed with an opening communicated with both said dust-receiving chamber and said conduit, said grinding wheel unit further including a generally U-shaped dust-guiding plate disposed within said dust-receiving chamber and having an end connected fixedly to said protective cover, said dust-guiding plate having a lower end disposed around said opening in said support seat so as to guide dust from said grinding wheel into said opening.

3. The grinding machine as claimed in claim 1, wherein said base includes a base plate and a surrounding plate extending integrally and perpendicularly from an outer periphery of said base plate and disposed around said driving pulley and said driven pulley, said conduit having an outlet end extending into said accommodating chamber in said abrasive belt unit, said dust-guiding unit further including a stop plate disposed within said accommodating chamber in said abrasive belt unit and connected fixedly to said base plate, said stop plate being spaced apart from said surrounding plate and having a first end disposed directly above and adjacent to said outlet end of said conduit, and a second end abutting against said side cover and disposed directly above and adjacent to said dust passage port in said side cover so as to guide dust from said outlet end of said conduit into said dust passage port.

4. The grinding machine as claimed in claim 1, wherein said support seat of said grinding wheel unit is provided with a fixed horizontal leg plate that is formed with a threaded hole therethrough, said grinding wheel unit further including a vertical first adjustment bolt engaging said threaded hole in said leg plate of said support seat, said base of said abrasive belt unit having opposite front and rear sides that are provided respectively with two fixed horizontal leg plates, each of which is formed with a threaded hole therethrough, said abrasive belt unit further including two vertical adjustment bolts engaging respectively said threaded holes in said leg plates of said base.

5. The grinding machine as claimed in claim 1, wherein said dust-collecting seat includes a C-shaped plate connected fixedly to and extending perpendicularly from said side cover and having two ends, and a dust-discharging tube connected fixedly to said side cover and having an inlet end connected fixedly to said ends of said C-shaped plate, and an outlet end opposite to said inlet end of said dust-discharging tube, said outlet end of said dust-discharging tube defining said dust outlet in said dust-collecting seat.

6. The grinding machine as claimed in claim 5, further comprising a dust-collecting bag disposed on said outlet end of said dust-discharging tube for receiving dust moving from said outlet end of said dust-discharging tube.

* * * * *